US007654274B1

(12) United States Patent
Yu

(10) Patent No.: US 7,654,274 B1
(45) Date of Patent: Feb. 2, 2010

(54) UMBRELLA

(76) Inventor: Feng-To Yu, No.45, Lane 294, Sec.4, Chenggong Rd., Neihu District, Taipei City 114 (TW)

( * ) Notice: Subject to any disclaimer, the term of this patent is extended or adjusted under 35 U.S.C. 154(b) by 0 days.

(21) Appl. No.: 12/219,968

(22) Filed: Jul. 31, 2008

(51) Int. Cl.
*A45B 25/18* (2006.01)

(52) U.S. Cl. ..... 135/33.4; 135/33.2; 135/31

(58) Field of Classification Search ..... 135/31, 135/33.2, 33.4
See application file for complete search history.

(56) References Cited

U.S. PATENT DOCUMENTS 2,221,289 A * 11/1940 Okun ..... 135/31
5,121,764 A * 6/1992 Wu ..... 135/31
5,305,772 A * 4/1994 Lai ..... 135/33.4
5,488,966 A * 2/1996 Baldwin et al. ..... 135/33.2

* cited by examiner

*Primary Examiner*—David Dunn
*Assistant Examiner*—Danielle Jackson
(74) *Attorney, Agent, or Firm*—Rosenberg, Klein & Lee

(57) ABSTRACT

An umbrella includes a shaft, a notch, a runner, a plurality of ribs, a plurality of stretchers, a plurality of tips and an umbrella cloth. The notch is fixed with the shaft, the runner slides on the shaft, the ribs are connected with the notch pivotally, the stretchers are pivotally connected between the runner and the ribs, the tips are fixed to the ribs, two ribs are inserted into each tip, and there is a clearance between the two ribs inserted into the same tip, umbrella cloth is fixed with ribs, ribs are covered with umbrella cloth, and umbrella cloth has a plurality of folded parts passing through the clearances respectively. Accordingly, the umbrella cloth of the invention is different from a conventional umbrella cloth which is made by sewing together many small panels of waterproof cloth with each other, so that the umbrella cloth has higher waterproof ability.

2 Claims, 4 Drawing Sheets

UMBRELLA

BACKGROUND OF THE INVENTION

1. Field of the Invention

The present invention relates to an umbrella, especially to an umbrella having an improved umbrella cloth.

2. Description of Related Art

The umbrella cloth of a conventional umbrella is made by sewing together many panels of waterproof cloth with each other. If a conventional umbrella is used for a long time, rain can increasingly penetrate the umbrella cloth through the seams of the umbrella cloth. In addition, because the conventional umbrella cloth consists of many panels, patterns of the conventional umbrella cloth are interrupted by seams, so that patterns are not continuous.

Hence, the inventors of the present invention believe that the shortcomings described above are able to be improved and finally suggest the present invention which is of a reasonable design and is an effective improvement.

SUMMARY OF THE INVENTION

An object of the present invention is to provide an umbrella, which has higher waterproof ability, and patterns of the umbrella cloth are continuous.

The umbrella includes a shaft, a notch, a runner, a plurality of ribs, a plurality of stretchers, a plurality of tips and an umbrella cloth. The notch is fixed at the top end of the shaft, the runner slides on the shaft, the ribs are connected with the notch pivotally, the stretchers pivotally are connected between the runner and the ribs, the tips are fixed to the ribs, whereby two ribs are inserted into each tip, and there is a clearance between the two ribs inserted into the same tip, the umbrella cloth is fixed to the ribs, the ribs are covered with the umbrella cloth, and the umbrella cloth has a plurality of folded parts passing through the clearances respectively.

The efficacy of the present invention is as follows: the umbrella cloth of the invention is different from a conventional umbrella cloth which is made by sewing together many small pieces of waterproof cloth with each other, so that rain can not penetrate through the umbrella cloth easily. In addition, patterns of the umbrella cloth are not interrupted by seams, so that patterns are continuous.

DETAILED DESCRIPTION OF THE PREFERRED EMBODIMENTS

Figure 1:
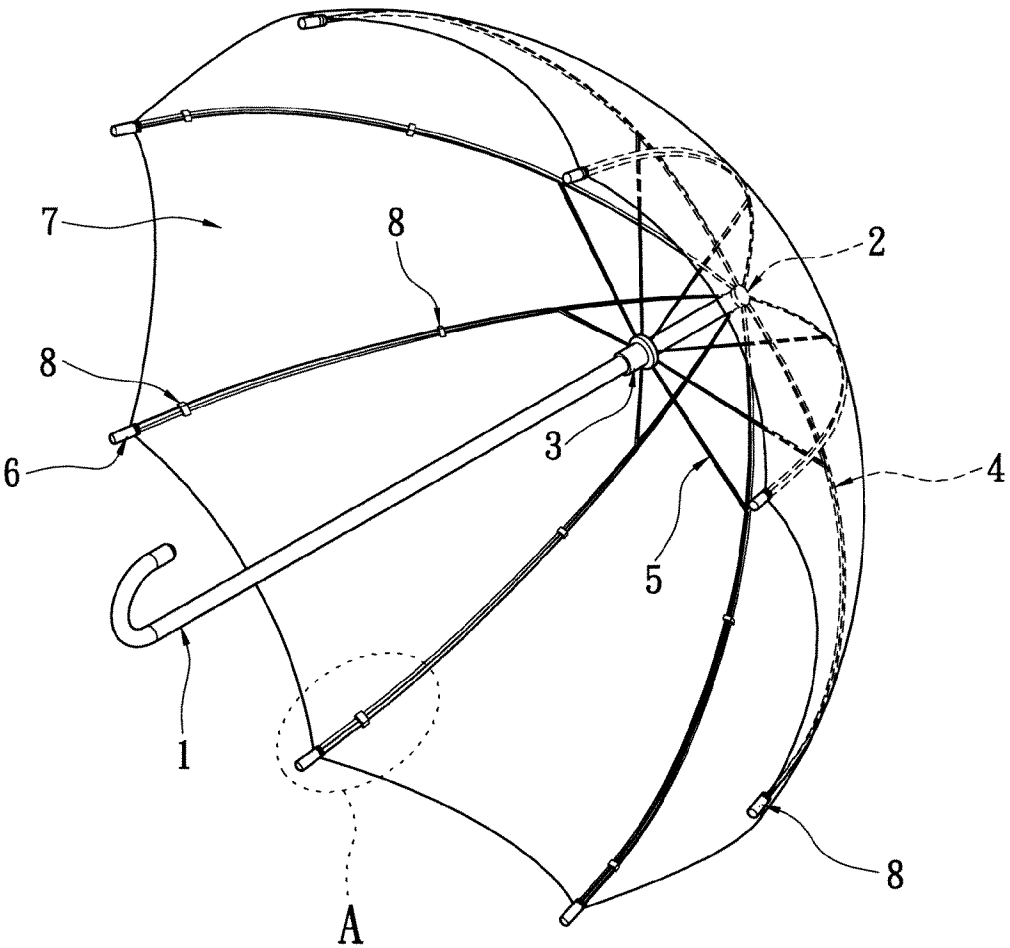
FIG. 1 is a perspective view of an umbrella according to the present invention.
Figure 2:
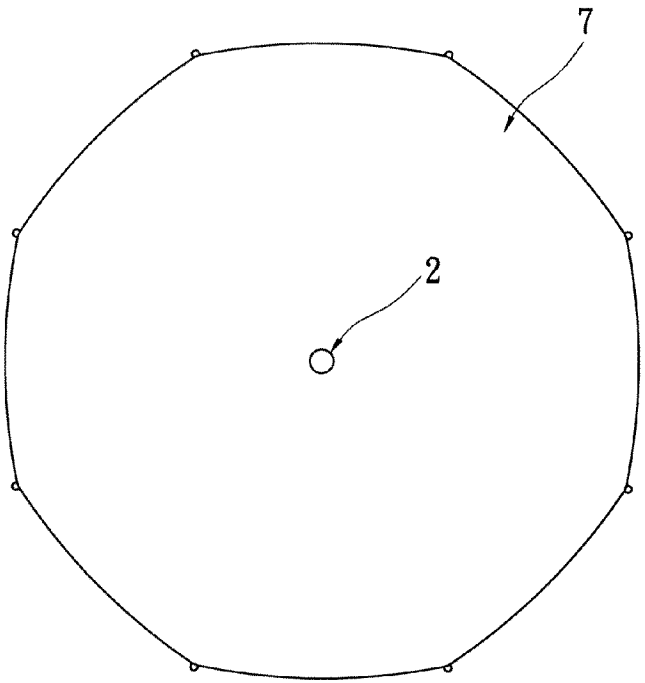
FIG. 2 is a top view of the umbrella according to the present invention.
Figure 3A:
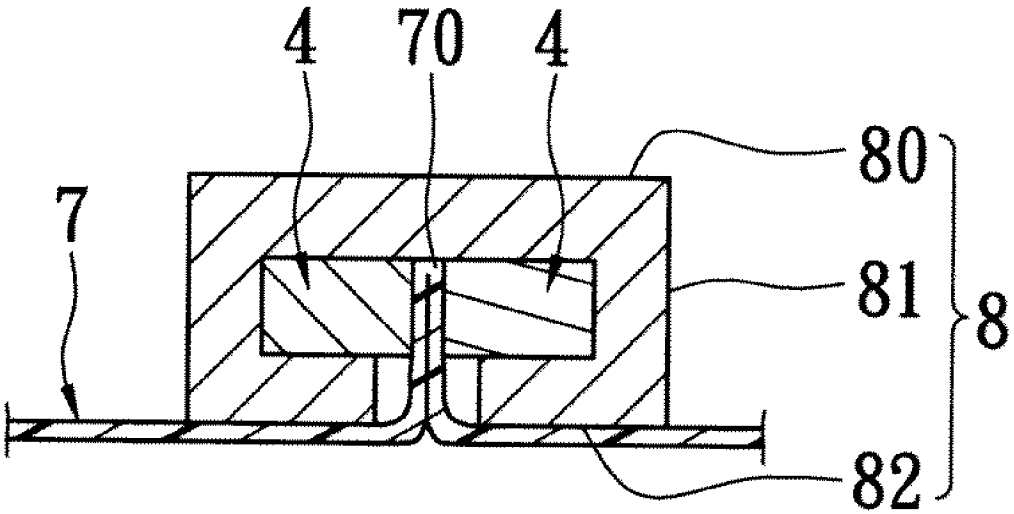
FIG. 3A shows a cross-sectional view of the clamp according to the present invention.

As shown in FIG. 1 and FIG. 2, an umbrella according to the present invention includes a shaft 1 with a top end and a bottom end, a notch 2, a runner 3, a plurality of ribs 4, a plurality of stretchers 5, a plurality of tips 6, an umbrella cloth 7 and a plurality of clamps 8. The notch 2 is fixed at the top end of the shaft 1, the runner 3 slides on the shaft 1, and the runner 3 is underneath the notch 2. The ribs 4 are pivotally connected in intervals to an edge of the notch 2, the stretchers 5 are pivotally connected between an edge of the runner 3 and the ribs 4. If a user pushes the runner 3 to slide toward the top end of the shaft 1, the ribs 4 and the stretchers 5 will be opened. If the user pulls the runner 3 to slide toward the bottom end of the shaft 1, the ribs 4 and the stretchers 5 will be closed.

Figure 3:
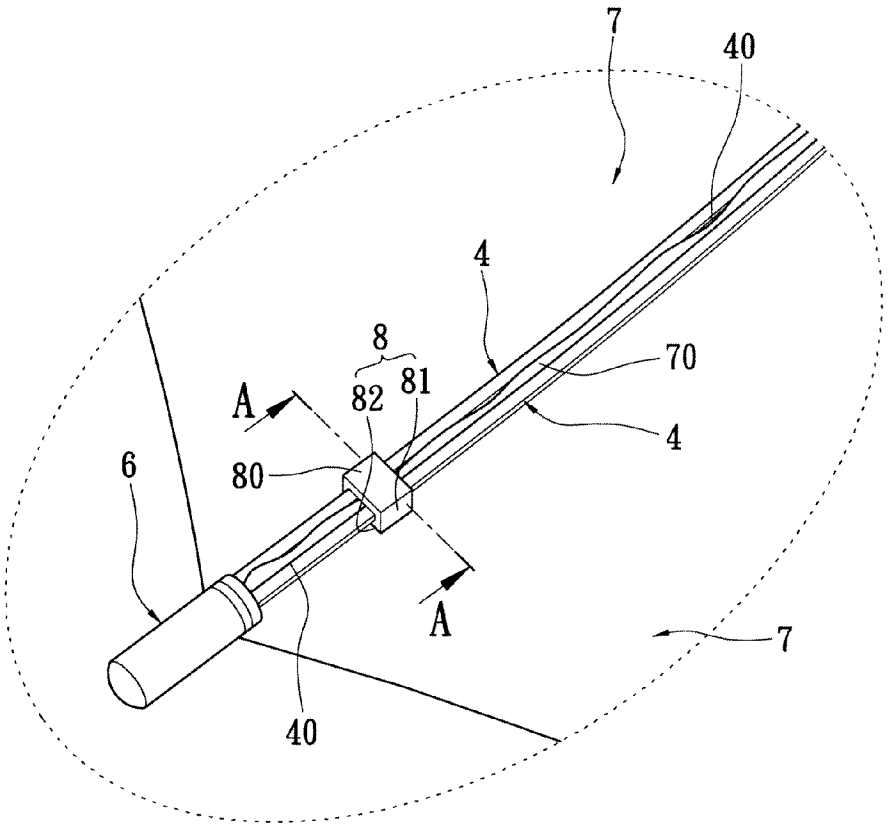
FIG. 3 is a partial enlarged view of FIG. 1.

As shown in FIG. 1 and FIG. 3, the tips 6 are attached to ribs 4, whereby two ribs 4 are inserted into each tip 6, and there is a small clearance 40 between the two ribs 4 inserted into the same tip 6. The umbrella cloth 7 is waterproof cloth, the ribs 4 are covered with the umbrella cloth 7, and the umbrella cloth 7 is fixed with the ribs 4. The umbrella cloth 7 has a plurality of folded parts 70 passing through the clearances 40 respectively. Each of the clamps 8 includes a base portion 80, two first fixing portions 81 and two second fixing portions 82, whereby the two first fixing portions 81 are at right angles to the base portion 80 and extend into the same direction from two opposite sides of the base portion 80. The second fixing portions 82 are parallel to the base portion 80 and are connected at right angles to the ends of the first fixing portions 81. The ribs 4 are clipped by the base portion 80, the first fixing portion 81, and the second fixing portions 82. The clamps 8 clip the ribs 4, and the ribs 4 clip the folded cloth portions 70.

Figure 4:
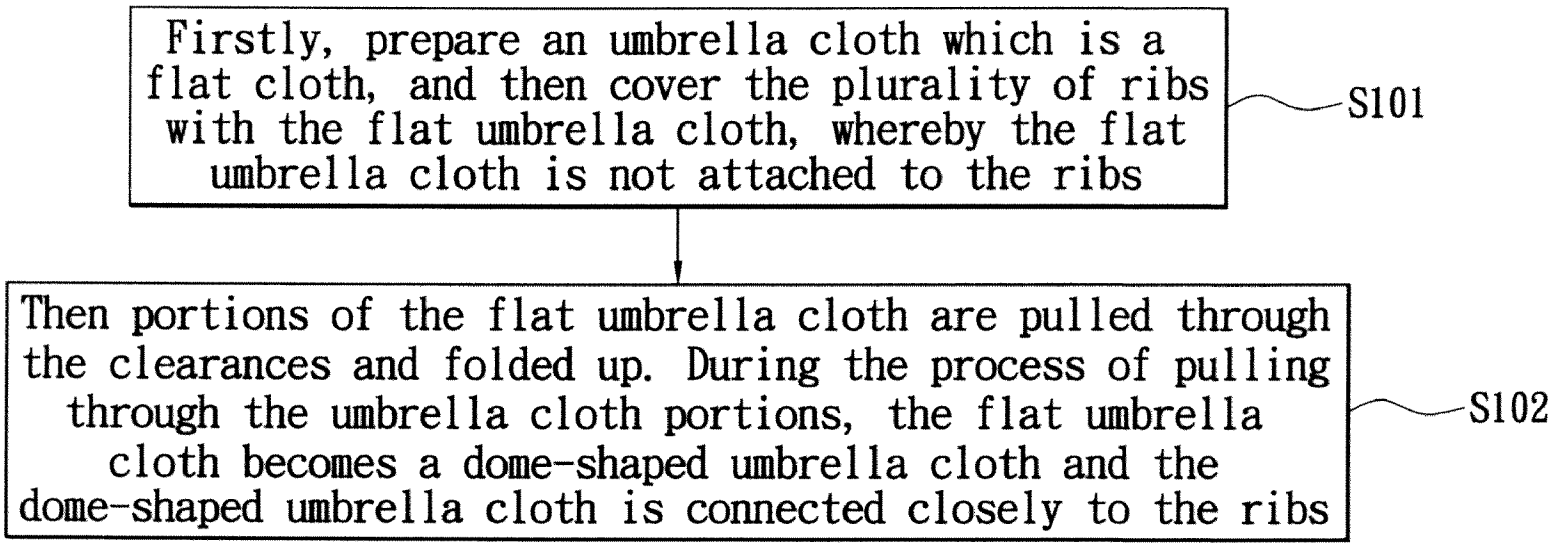
FIG. 4 is an assembling flowchart for the umbrella cloth and ribs according to the present invention.

In FIG. 4 an assembling flowchart for the umbrella cloth 7 and the ribs 4 according to the present invention is presented:

S101: Firstly, prepare an umbrella cloth which is a flat cloth, and then cover the plurality of ribs 4 with the flat umbrella cloth, whereby the flat umbrella cloth is not attached to the ribs 4.

S102: Then portions of the flat umbrella cloth are pulled through the clearances 40 and folded up. During the process of pulling through the umbrella cloth portions, the flat umbrella cloth becomes a dome-shaped umbrella cloth 7 and the dome-shaped umbrella cloth 7 is connected closely to the ribs 4.

Consequently, the advantages of the umbrella of the present invention are as follows:

1. the umbrella cloth 7 of the invention is different from a conventional umbrella cloth made by sewing together many small pieces of waterproof cloth with each other, so that rain can not penetrate through the umbrella cloth 7 easily. In addition, patterns of the umbrella cloth 7 are not interrupted, so that the patterns are continuous.

What are disclosed above are only the specification and the drawings of the preferred embodiments of the present invention and it is therefore not intended that the present invention be limited to the particular embodiments disclosed. It will be understood by those skilled in the art that various equivalent changes may be made depending on the specification and the drawings of the present invention without departing from the scope of the present invention.

What is claimed is:

1. An umbrella, comprising:

a shaft with a top end and a bottom end;

a notch fixed at the top end of the shaft;

a runner sliding on the shaft;

a plurality of ribs connected with the notch pivotally;

a plurality of stretchers pivotally connected between the runner and the ribs;

a plurality of tips fixed to the ribs, wherein two ribs are inserted into each tip forming a clearance between the two ribs;

a plurality of clamps, each clamp having a base portion, a pair of first fixing portions and a pair of second fixing portions, whereby the two first fixing portions are at right angles to the base portion and extend into the same direction from two opposite sides of the base portion, the two second fixing portions are parallel to the base portion and are connected at right angles to the ends of the first fixing portions, and the ribs are clamped by the base portion, the first fixing portions, and the second fixing portions; and a waterproof umbrella cloth having a plurality of folds, said folds being passed through said clearances for clamped securement between the ribs by said plurality of clamps, wherein said clamps tightly clamp around said ribs for securement of said folded portions of said umbrella cloth.

2. The umbrella as in claim 1, wherein the runner is underneath the notch.

* * * * *